US009016101B2

(12) United States Patent
Pick et al.

(10) Patent No.: US 9,016,101 B2
(45) Date of Patent: Apr. 28, 2015

(54) TOOL AND METHOD FOR THE MANUFACTURE OF CANS

(75) Inventors: Gerhard Pick, Wäschenbeuren (DE); Martin Gaebges, Albershausen (DE)

(73) Assignee: Schuler Pressen GmbH & Co. KG, Göppingen (DE)

( * ) Notice: Subject to any disclaimer, the term of this patent is extended or adjusted under 35 U.S.C. 154(b) by 432 days.

(21) Appl. No.: 12/930,785

(22) Filed: Jan. 14, 2011

(65) Prior Publication Data

US 2011/0174045 A1 Jul. 21, 2011

(30) Foreign Application Priority Data

Jan. 15, 2010 (DE) ..... 10 2010 000 094

(51) Int. Cl.
*B21D 51/26* (2006.01)
*B21D 22/22* (2006.01)
*B21D 22/28* (2006.01)

(52) U.S. Cl.
CPC ..... *B21D 51/26* (2013.01); *B21D 22/22* (2013.01); *B21D 22/28* (2013.01)

(58) Field of Classification Search
CPC ..... B21D 22/22; B21D 22/28; B21D 51/26
USPC ..... 72/347–349; 413/76
See application file for complete search history.

(56) References Cited

U.S. PATENT DOCUMENTS

| | | | | | |
|---|---|---|---|---|---|
| 353,439 | A * | 11/1886 | Butters | 72/349 |
| 1,602,411 | A * | 10/1926 | Rode | 72/417 |
| RE20,009 | E * | 6/1936 | Hothersall | 72/349 |
| 4,183,238 | A * | 1/1980 | Maillet | 72/349 |
| 5,357,779 | A * | 10/1994 | Hahn et al. | 72/347 |
| 7,287,408 | B2 * | 10/2007 | Kawai et al. | 72/349 |
| 8,387,435 | B2 * | 3/2013 | Bandou et al. | 72/389.8 |

FOREIGN PATENT DOCUMENTS

| | | | |
|---|---|---|---|
| DE | 2 353 209 | A | 11/1974 |
| WO | WO 2008/067522 | A1 | 6/2008 |
| WO | WO 2009/052608 | A1 | 4/2009 |

* cited by examiner

*Primary Examiner* — Debra Sullivan
(74) *Attorney, Agent, or Firm* — R. S. Lombard; K. Bach

(57) ABSTRACT

For the manufacture of can bodies as they are needed for the manufacture of aerosol cans or beverage cans, a special tool 2 is provided which combines the manufacture of the cup as well as the transformation of the cup into a can body into a single tool 3. The process is based on preferably round metal sheets which are first drawn in a first draw-stretching step of the tool 2 into cups and then are draw-stretched in a second draw-stretch process, the further draw- and slide-down-stretch to form can bodies. The drawing arrangements are the same in both operating steps. The tools required therefore are simple sturdy tools providing for a simple sturdy manufacturing process.

10 Claims, 5 Drawing Sheets

TOOL AND METHOD FOR THE MANUFACTURE OF CANS

CROSS-REFERENCE TO RELATED APPLICATION

This application claims the priority benefits of German Application No. 10 2010 000 094.9-14 filed Jan. 15, 2010.

BACKGROUND OF THE INVENTION

For the manufacture of pressure cans or beverage cans or similar hollow metallic bodies generally a metal sheet as base material is used which then is formed in several steps to the desired body. This transformation procedure comprises several deforming steps which are generally performed one after the other. Only in this way is it possible to achieve the desired high transformation grades.

WO 2008/067522 A1, for example, discloses a production line for the manufacture of beverage cans from round disc shaped metal shred blanks. Those blanks are first transferred in respective transformation equipment into a cup-shape. The cup-shaped interim unfinished blanks are then transported to further transformation machines which produce from the cup-shaped interim blanks the desired can bodies.

For this kind of manufacturing expensive special automatic equipment is required.

Furthermore, special automatic manufacturing equipment is known which are called Cuppers which produce cup-shaped interim blanks starting with a sheet metal strip. With the punching out of circular sections for forming cups waste is generated which must be disposed of. This is an additional problem for the operator.

WO 2009/052608 A1 proposes to perform the transformation of a planar metal plate into a can body in two steps in a single tool. The tool comprises two draw punches which move in opposite directions and are arranged coaxially relative to each other. The result is an invert-draw process which demands high requirements regarding the transformability of the material used.

It is the object of the application to provide an arrangement and a method for an efficient and reliable manufacture of can bodies.

SUMMARY OF THE INVENTION

For the manufacture of can bodies as they are needed for the manufacture of aerosol cans or beverage cans, a special tool 2 is provided which combines the manufacture of the cup as well as the transformation of the cup into a can body into a single tool 3. The process is based on preferably round metal sheets which are first drawn in a first draw-stretching step of the tool 2 into cups and then are draw-stretched in a second draw-stretch process, the further draw- and slide-down-stretch to form can bodies. The drawing arrangements are the same in both operating steps. The tools required therefore are simple sturdy tools providing for a simple sturdy manufacturing process.

The tool according to the invention combines the transformation of a planar metal sheet to a cup and the transformation of the cup into a can body in a two-step procedure in a single tool. This on one hand eliminates the need for providing separate automatic manufacturing equipment for manufacture of the cups and, on the other hand the draw-stretch procedure following the manufacture of the cup. Since with the tool according to the invention and the method according to the invention no invert-draw procedure is used, a simple and reliable manufacturing process is provided.

It is particularly advantageous to use the invention in the production of can bodies of materials which tend to strain harden. The manufacture of the cup and the subsequent stretch-draw process for the manufacture of the cup body occur time wise so close together that the transformation-based heating of the cup generally remains sufficient for the following stretch-draw procedure.

Strain hardening occurrences as they may happen on the way from a cup manufacturing device to the stretch drawer are not possible or minimized. This helps in providing a robust and reliable manufacturing process.

The concept according to the invention permits furthermore, a clear separation between movable and stationary tool parts. The movable draw plungers are both assigned to a movable tool part, for example, an upper tool. The respective canister molds and counter-support surfaces are in the stationary tool part, for example, a bottom tool. In this way, the respective position and/or force control of each draw punch can be optimally adjusted considering a suitable press concept. The travel and, respectively force control of the draw punch may, when necessary, be performed by components of the press, which reduces tool costs. In this way expensive, possibly controllable springs, hydraulic arrangements, pneumatic arrangements, control drives, etc can possibly be omitted. The actions of these components can be assigned with the concept of the present invention to the press and in this way realized by the press. Even if a large tool set for the manufacture of different cans needs to be stored this represents no particularly large expenditures.

BRIEF DESCRIPTION OF THE DRAWINGS

Further features of embodiments of the invention are disclosed in the following drawings, exemplary of the invention, in which.

DETAILED DESCRIPTION OF THE INVENTION

Figure 1:
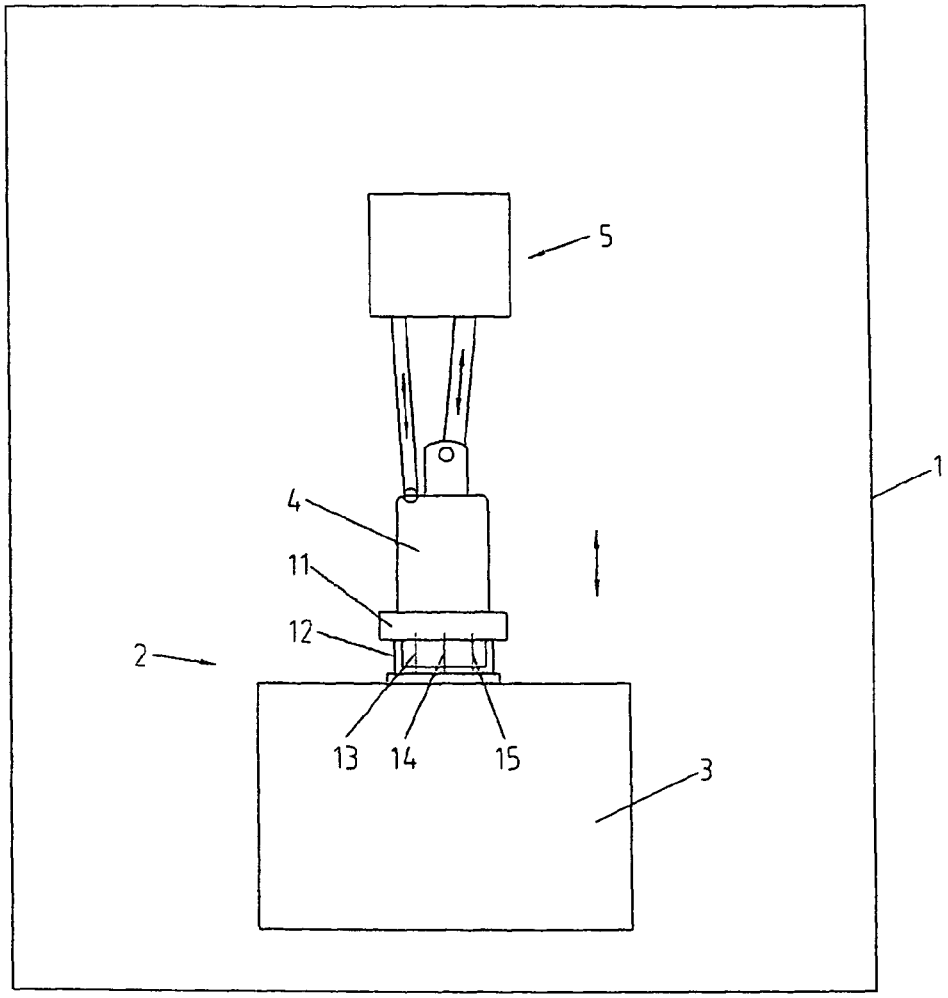
FIG. 1 shows a machine for the manufacture of can bodies with a tool according to the invention in a highly schematic representation.

FIG. 1 shows a transformation machine 1 which includes a tool 2 for the manufacture of can bodies. The tool 2 comprises a lower tool part 3 which is fixed in the transformation machine 1 and an upper tool part 4 which is supported so as to be linearly movable toward, and away from, the lower tool part 3. The tool parts 3, 4 may be arranged—as shown—vertically on top of one another but, if expedient, they may also be arranged in any other spatial orientation for example in side-by-side relationship or one behind the other. In the exemplary embodiment the direction of movement of the upper tool part 4 is vertical. However, the direction of movement may be oriented in any other suitable spatial orientation.

The upper tool part 4 is provided with a drive arrangement 5 which activates the various components of the upper tool part 4 in a suitable manner or applies forces thereto.

Figure 4:
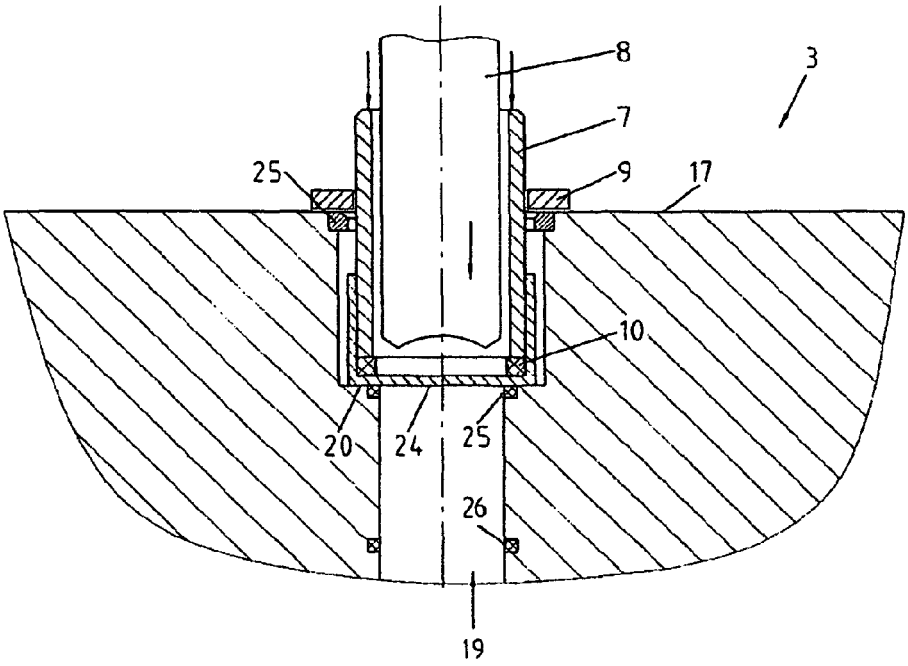
FIG. 4 shows the tool as shown in FIG. 3 with the cup finished.

FIG. 4 shows the tool 2 in a more detailed representation. As shown, the upper tool part 4 comprises several parts which are arranged concentric with regard to a center axis 6, that is a first extrusion punch 7, a second extrusion punch 8 and a downholder ring 9. The first extrusion punch 7 is tubular. At its lower front face a pressure ring 10 may expediently be arranged which is particularly wear-resistant and, in its slide friction properties, tuned to the material to be worked.

The first extrusion punch 7 is connected to a part of the drive arrangement 5 which is suitable to move the extrusion punch 7 in the direction of the center axis 6 in a position-controlled manner. Furthermore, the drive arrangement 5 is preferably so designed that the activation of the extrusion punch 7 can be switched from a position controlled operation to a force-controlled operation.

Figure 2:
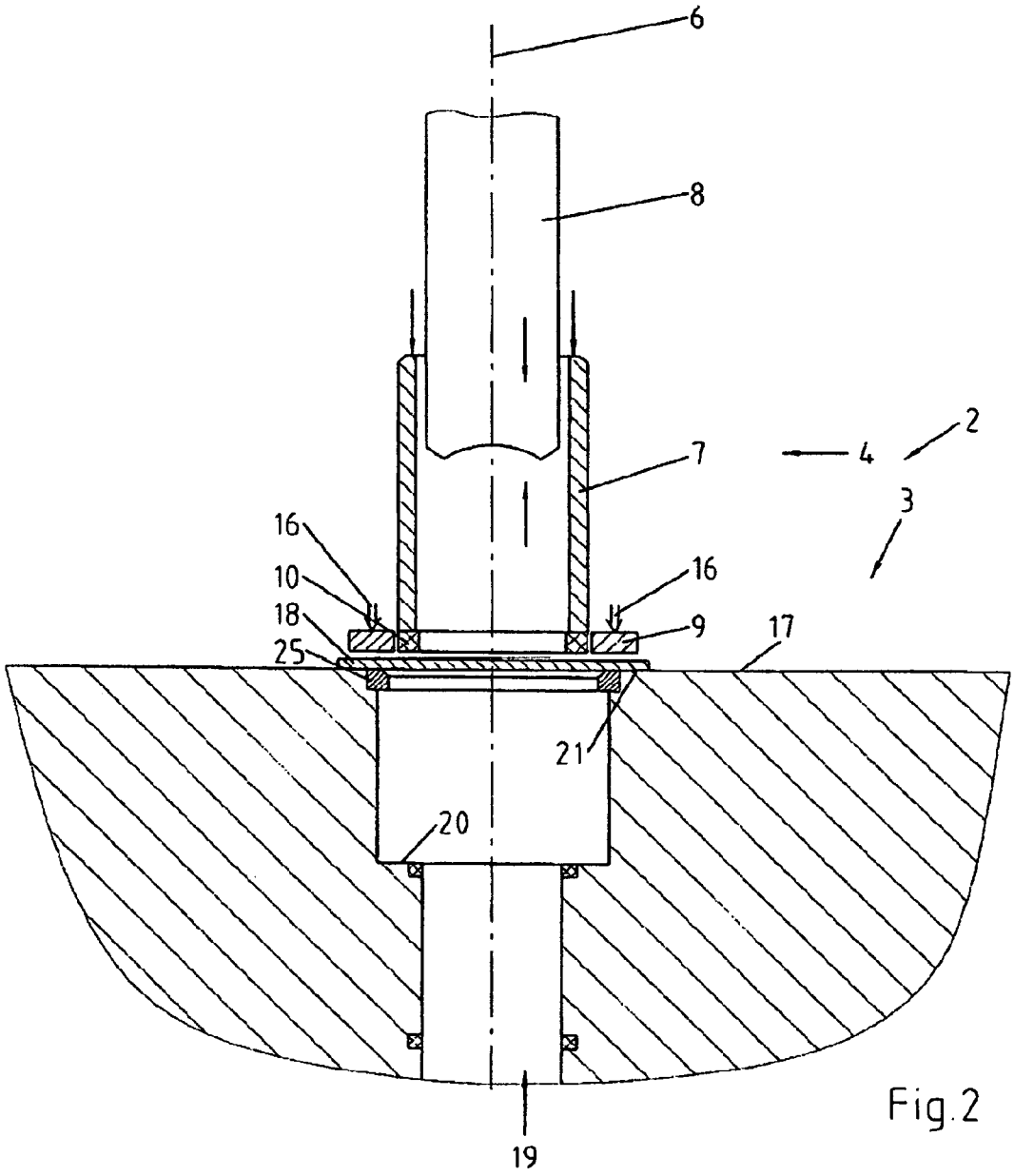
FIG. 2 shows the tool according to FIG. 1 in a highly schematic vertical cross-sectional view after insertion of the metal sheet.

The first extrusion punch 7 is provided with a downholder ring 9 which is connected to the first extrusion punch 7 by way of corresponding tensioning means, for example, a spring arrangement 11 and pressure studs 12, 13, 14, 15 (see FIG. 1) in order to generate a defined force indicated in FIG. 2 by arrows 16.

The second extrusion punch 8 which also is part of the upper tool part 4 is arranged in the interior of the first extrusion punch 7 so as to be moveable there along the center axis 6. Its lower front face 17 is shaped preferably in accordance with the desired inner shape of the bottom of the can body to be formed.

The lower tool part 3 includes several parts which are shown in FIG. 2 for simplicity reasons as a single part. The lower tool part 3 is provided at its side facing the upper tool part 4 with a preferably planar surface 17 for supporting a metal sheet 18 which is preferably in the form of a round disc. The surface 17 forms the counter-support surface for the downholder 9.

Concentrically with the center axis 6 a stepped through-passage 19 is formed in the lower tool part 3. Starting at the surface 17 the passage 19 first has a diameter which is greater then the outer diameter of the first extrusion punch 7. At a step 20 the through passage 19 diameter becomes smaller than the outer diameter of the first extrusion punch 7, but is still larger than the outer diameter of the second extrusion punch 8. When the extrusion punch 7 moves into the through passage 19, it defines with the passage wall an annular gap whose width is apparent from the following description of operation of the device. When the second extrusion punch 8 moves into the smaller diameter lower part of the through passage 19 it defines with the passage wall again an annular gap whose width will also be apparent from the following description of operation. The same is true for the distance between the step 20 and the surface area 17.

With the tool 2 described above, can bodies are manufactured as follows:

For the manufacture of a can body, first the metal sheet 18 is placed onto the surface 17 so that it is centered relative to the center axis 6 and the tool 2 is then closed. To this end, the upper tool part is moved toward the lower tool part. The downholder ring 9 is then seated on the metal sheet 18 and presses it against the counter support surface 21 with a controlled force. The counter support surface 21 is herein that part of the surface 17 which extends immediately around the through passage 19.

Figure 3:
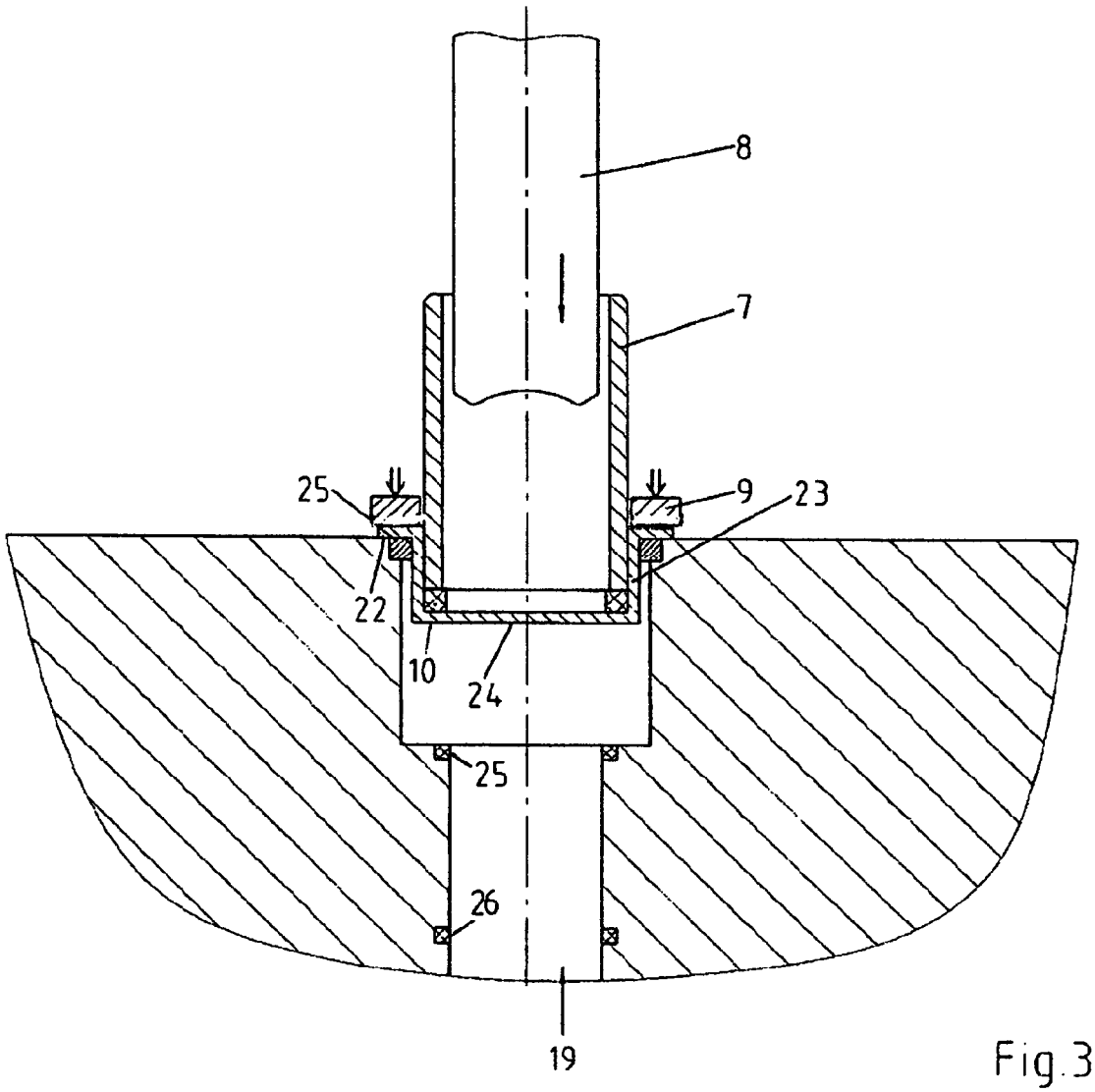
FIG. 3 shows the tool as shown in FIG. 1 during the deep-draw procedure for making the cup.

With further downward movement of the first extrusion punch 7, the first punch is seated with its pressure ring 10 on the metal sheet 18 and draws into the through-passage 19 in a deep draw procedure. This procedure of drawing the cup is shown in FIG. 3. During the drawing of the cup by the first extrusion punch 7, the rim 22 of the metal sheet 18 slides below the downholder ring 9 inwardly in a controlled manner. By the deep-draw procedure a cup with a cylindrical wall 23 and a flat bottom 24 is formed.

FIG. 4 shows the tool 3 after completion of deep-draw procedure. The downholder ring 9 is now no longer functional. The first draw punch 7 has moved the cup formed far into the through-passage 19 that the bottom 24 has arrived at the step 20. The pressure ring 10 presses from within onto the bottom 24 and as a result, the bottom 24 against the step 20. At this state, the first extrusion punch 7 changes its function from a draw function to a downholder function. To this end, the respective drive of the extrusion punch 7 may be so designed that it can assume different modes of operation. For example, the first extrusion punch 7 may be controlled during the drawing procedure on the basis of a travel distance or for example on a position basis. This can be done by way of a suitable transmission depending on a drive or also via position controlled drives. When the bottom 24 abuts the step 20, the drive of the extrusion punch 7 switches, for example, to a force controlled operation. This can be achieved with a mechanical drive by the provision of suitable spring means arranged in the force transmission path, if needed force-controllable or switchable spring means. Alternatively, a force detection and force control may be used if suitable drives are provided.

Figure 5:
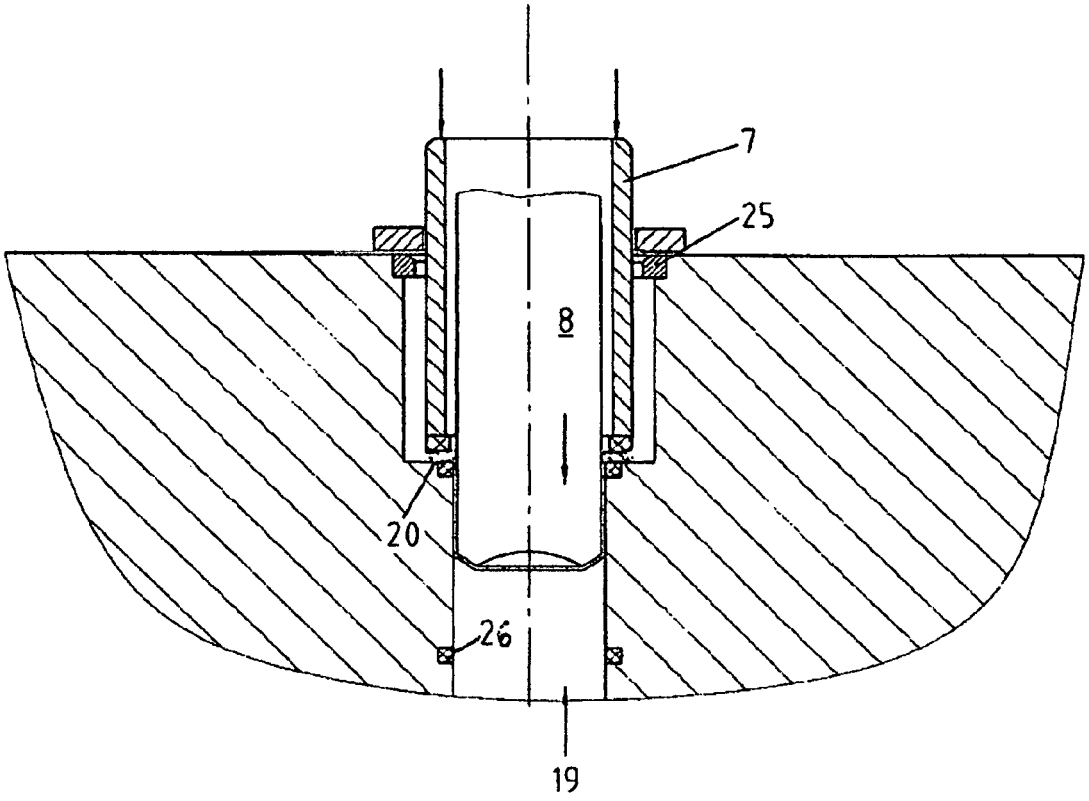
FIG. 5 shows the tool as shown in FIGS. 2-4 during the stretch-slide drawing.

During a position-controlled operation, the respective punch is moved by a drive (for example servo drive) in accordance with a predetermined travel distance-time curve. During force-controlled operation a force is applied to the punch corresponding to a predetermined force or a predetermined force graph. At the latest when the first extrusion punch 7 and the bottom 24 have arrived at the step 20, the second extrusion punch 8 advances in the same direction as did earlier the now resting first extrusion punch 7 (that is here downwardly). The movement of the second extrusion punch 8 may also have been started earlier, wherein however the second extrusion punch 8 does not come in contact with the bottom 24 during the deep drawing of the cup. But now the second extrusion punch 8 abuts the bottom 24 and starts the stretch-drawing procedure which is shown in FIG. 5. Herein the first, force-controlled extrusion punch 7 acts as a downholder which permits a controlled sliding of the cup material into the annular gap between the second extrusion punch 8 and the narrower part of the through-passage 19. In this second drawing procedure, the desired can body is formed. The wall thickness of the can body is reduced in the process and adjusted to the desired value. The direction of the operating stroke of the first extrusion punch 7 is the same as the direction of the operating stroke of the second extrusion punch 8. The extrusion punches 7 and 8 are therefore moved running in the same direction. The first and the second drawing procedure occur therefore also in the same direction, that is in the same tool time wise one after the other and unidirectionally. During further drawing and stretching the can body is guided through draw rings 25, 26 which are arranged in the wall of the through-passage 19 on top of one another in axially spaced relationship. The annular gap formed between the draw rings and the draw punch 8 determines the wall thickness of the can body to be formed. The draw rings 25, 26 calibrate the outer diameter of the can body. The procedure is called "abstrecken" draw-stretching.

The manufacture of the can occurs in a two-step process. In the first drawing step, the first extrusion punch 7 is active whereas the second extrusion punch 8 is inactive that is it does not act on the material of the can body. In a second drawing step, the first extrusion punch 7 acts as a downholder, whereas the second extrusion punch 8 is active and effects the further drawing and draw-stretching.

As shown in the two-step drawing procedure, the material of the metal sheet 18 is guided in a zigzag path. From a horizontal orientation which is determined by the surface 17, the material first moves in a vertical direction parallel to the center axis 6, so as to form the cylinder wall. From there, the material flows in a quasi Z-shaped path that is in a right-left bend over the step 20 in order to form the can wall. Invert processes wherein the wall material is bent twice in the same direction are avoided.

LIST OF REFERENCE NUMERALS

1 transformation machine
2 tool
3 lower tool part
4 upper tool part
5 drive arrangement
6 center axis
7 first extrusion punch
8 second extrusion punch
9 downholder ring
10 pressure ring
11 spring arrangement
12 pressure pins 13-15
16 arrow
17 surface
18 metal sheet
19 through-passage
20 step
21 counter surface
22 rim
23 wall
24 bottom
25 upper draw ring
26 lower draw ring

What is claimed is:

1. A tool (2) for the manufacture of a can body carried by a transformation machine (1) comprising:

a lower tool part (3) operably affixed to and supported by the transformation machine (1), an upper tool part (4) operably supported to be linearly movable toward, and away from the lower tool part (3), the upper tool part (4) including a servo drive arrangement (5), the upper tool part (4) comprising a first extrusion punch (7) in operable arrangement with the servo drive arrangement (5), the upper tool part (4) operably arranged concentric to a center axis (6), a first downholder (9) in operable arrangement with the first extrusion punch (7), the upper tool part (4) comprising a second extrusion punch (8) operably arranged in the interior of the first extrusion punch (7) so as to be movable along the center axis (6), the lower tool part (3) having a planar surface (17) for supporting a planar metal sheet (18) to be formed finally into the can body, the lower tool part (3) having a stepped through-passage (19) therein concentric with the center axis (6), the stepped through-passage (19) including an annular step (20), the first extrusion punch (7) for operatively passing within the stepped through-passage (19) above the annular step (20), the second extrusion punch (8) for operatively passing within the stepped through-passage (19) below the annular step (20), the first downholder (9) in operative arrangement with the first extrusion punch (7) for initially applying a controlled force to the planar sheet (18) for forming a pre-can body cup from the planar metal sheet (18), the servo drive arrangement (5) which is operable selectively electronically switchable between a first operating mode and a second operating mode, the first operating mode of the servo drive arrangement (5) is a position controlled operation for detecting the position of the extrusion punch (7) and moving the extrusion punch (7) based on feedback of the detected position of the extrusion punch (7) in accordance with a predetermined travel distance-time curve for moving the first extrusion punch (7) in a coordinated manner with the second extrusion punch (8) above the annular step (20) until the first extrusion punch (7) reaches the annular step (20) and the second operating mode is a force controlled operation for controlling electronically the force applied by the first extrusion punch (7) to the pre-can body cup between the first extrusion punch (7) and the annular step (20) in a downhold function by detecting the force applied by the first extrusion punch (7) to the pre-can body cup for ensuring correspondence to a predetermined force or a predetermined force graph, the switching of the servo drive arrangement (5) from the first operating mode to the second operating mode is executed when the first extrusion punch (7) changes its function from a draw function to the downhold function at the annular step (20), the second extrusion punch (8) arranged coaxially with the first extrusion punch (7) for further drawing and stretching the pre-can body cup below the annular step (20) for forming the can body, and, the first extrusion punch (7) and the second extrusion punch (8) are driven to run in the same direction.

2. A tool according to claim 1, wherein the second extrusion punch (8) is arranged longitudinally movably in a passage formed centrally in the first extrusion punch (7).

3. A tool according to claim 1, wherein the first extrusion punch (7) is tubular.

4. A tool according to claim 1, wherein the first downholder (9) and a first downholder counter surface (21) are in operable arrangement with the first extrusion punch (7) during the first operating mode.

5. A tool according to claim 4, wherein a second downholder and a stationary second downholder counter surface are in operable arrangement with the first extrusion punch (7) during the second operating mode.

6. A tool according to claim 5, wherein the second downholder comprises a pressure ring (10) in operable arrangement with the first extrusion punch (7).

7. The tool according to claim 5, wherein the stationary second downholder counter surface is formed by an annular step (20) which is arranged at a fixed distance from the first downholder counter surface (21).

8. The tool according to claim 4, wherein the first downholder counter surface (21) is formed by the planar surface (17).

9. The tool according to claim 1, wherein the servo drive arrangement (5) is also for controlling the second extrusion punch (8) operable selectively electronically in a position or force-controlled manner.

10. A method for the manufacture of a can body with a tool (2) carried by a transformation machine (1), the tool (2) including a lower tool part (3) operably affixed to and supported by the transformation machine (1), an upper tool part (4) operably supported to be linearly movable toward, and away from the lower tool part (3), the upper tool part (4) including a servo drive arrangement (5), the upper tool part (4) comprising a first extrusion punch (7) in operable arrangement with the servo drive arrangement (5) and operably arranged concentric to a center axis (6), a first downholder (9) in operable arrangement with the first extrusion punch (7), the upper tool part (4) comprises a second extrusion punch (8) operably arranged in the interior of the first extrusion punch (7) so as to be movable along the center axis (6), the lower tool part (3) having a planar surface (17) for supporting a planar metal sheet (18) to be finally formed into the can body, the lower tool part (3) having a stepped through-passage (19) therein concentric with the center axis (6), the stepped through-passage (19) including an annular step (20), the first extrusion punch (7) for operatively passing within the stepped through-passage (19) above the annular step (20), the second extrusion punch (8) for operatively passing within the stepped through-passage (19) below the annular step (20), a second extrusion punch (8) arranged coaxially with the first extrusion punch (7), the servo drive arrangement (5) for operable selective electronic switching between a first operating mode which is a position controlled operation and a second operating mode which is a force controlled operation said method comprising the steps of:

forming a pre-can body cup by deep drawing in a predetermined draw direction from a pre-cut planar metal sheet (17) by deep-drawing with the servo drive arrangement (5) by detecting the position of the extrusion punch (7) and moving the extrusion punch (7) based on feedback of the detected position of the extrusion punch (7) in the first operating mode in accordance with a predetermined travel distance-time curve causing the first extrusion punch (7) to move in a coordinated manner with the second extrusion punch (8) until the first extrusion punch (7) reaches the annular step (20) and, in a second step, deep drawing and stretching the pre-can body cup in the same predetermined draw direction for forming the can body by the servo drive arrangement (5) electronically switching to the second operating mode for causing the first extrusion punch (7) of the first deep-draw step serving as a downholder in operable relationship with the annular step (20) for the second deep-draw step and for controlling electronically the force applied by the first extrusion punch (7) to the pre-can body cup during downholding and for detecting the force applied by the first extrusion punch (7) to the pre-can body cup for ensuring correspondence to a predetermined force or a predetermined force graph to produce the can body.

* * * * *